US010342257B2

(12) United States Patent
Zeitlin

(10) Patent No.: US 10,342,257 B2
(45) Date of Patent: Jul. 9, 2019

(54) CONTAINERS WITH MULTI-FUNCTIONAL CAPS

(71) Applicant: Eric S. Zeitlin, Boulder, CO (US)

(72) Inventor: Eric S. Zeitlin, Boulder, CO (US)

( * ) Notice: Subject to any disclaimer, the term of this patent is extended or adjusted under 35 U.S.C. 154(b) by 665 days.

(21) Appl. No.: 14/656,665

(22) Filed: Mar. 12, 2015

(65) Prior Publication Data

US 2016/0262448 A1 Sep. 15, 2016

(51) Int. Cl.
*A24F 9/02* (2006.01)
*A24F 19/10* (2006.01)
*A24F 23/00* (2006.01)

(52) U.S. Cl.
CPC ..... *A24F 23/00* (2013.01); *A24F 9/02* (2013.01); *A24F 19/10* (2013.01)

(58) Field of Classification Search
CPC ..... A24F 23/00; A24F 19/10; A24F 9/02
See application file for complete search history.

(56) References Cited

U.S. PATENT DOCUMENTS 1,356,586 A 10/1920 Aisenstein
1,998,742 A 4/1935 Sussman
2,106,313 A 1/1938 Amrine
2,149,698 A 3/1939 Humphrey
2,175,735 A 10/1939 Banks
2,725,884 A 12/1955 Colby
3,413,981 A 12/1968 Polizzi
4,043,348 A * 8/1977 Kanady ..... A24F 9/02 131/243
4,177,823 A * 12/1979 Glasser ..... A24F 9/04 131/184.1
4,717,032 A 1/1988 Wu
5,251,774 A 10/1993 Engle
2013/0025608 A1* 1/2013 Fakhouri ..... A24F 9/16 131/311

* cited by examiner

*Primary Examiner* — Lore R Jarrett

(57) ABSTRACT

The present invention relates to containers having caps with smoking tools attached thereon, including an ashtray with a poker protruding inwards from its associated cap, and a jar for smoking materials having a combination scoop and packer protruding inwards from its associated cap. More than one container may be temporarily attached to another container via a single or multiple caps having means of attachment to another cap, and the caps may contain means for grinding material. The present invention makes loading and packing into, and removing ash from, a smoking device faster, easier, neater, and more convenient.

2 Claims, 7 Drawing Sheets

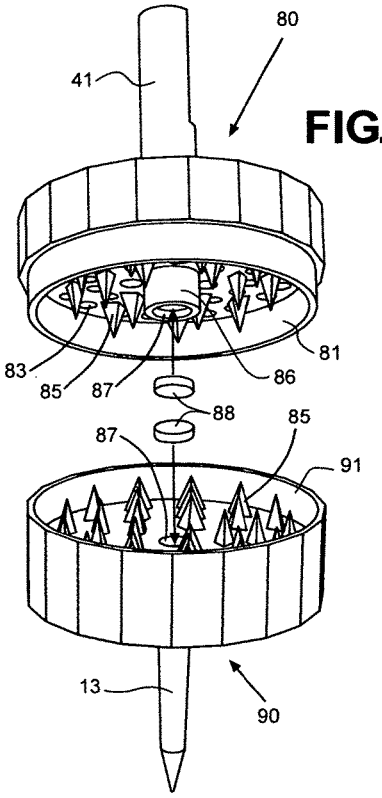
FIG. 9
FIG. 10
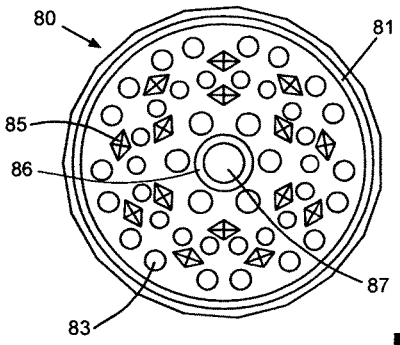
FIG. 11
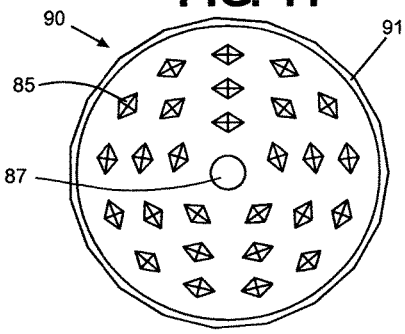
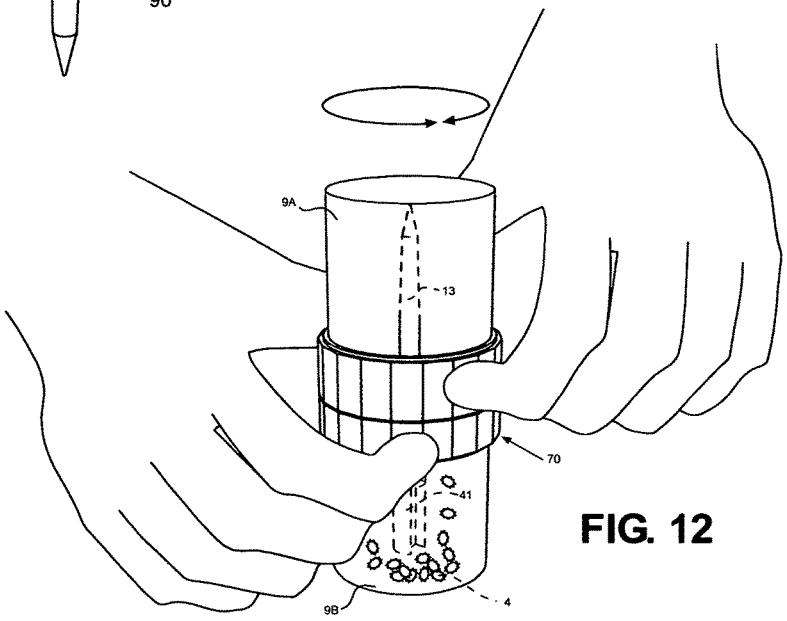
FIG. 12

FIG. 17
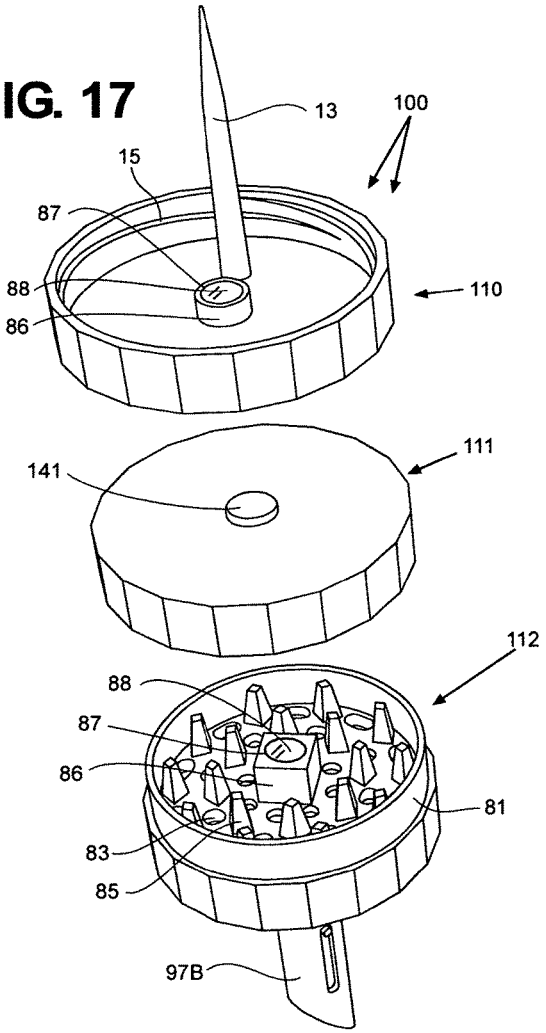
FIG. 18
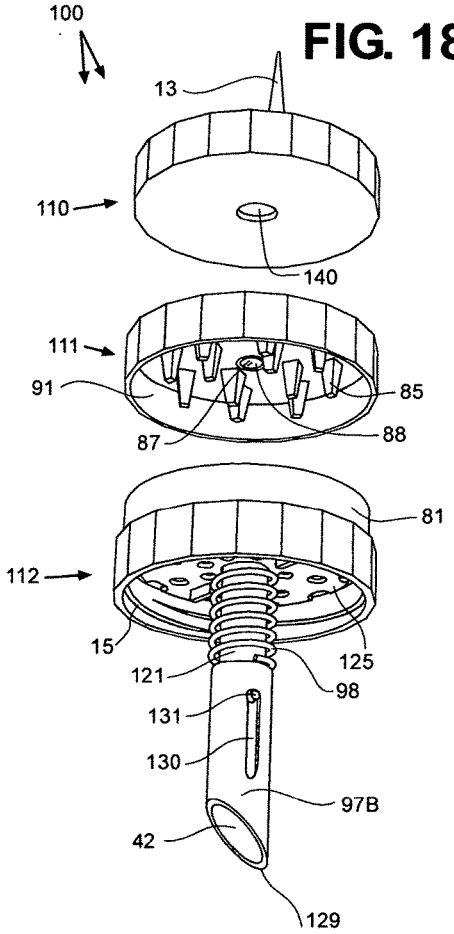
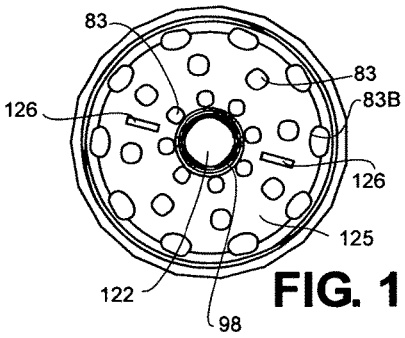
FIG. 16A
FIG. 16B
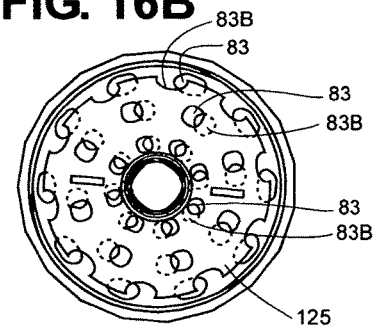

CONTAINERS WITH MULTI-FUNCTIONAL CAPS

This application claims priority from Provisional Patent Application No. 61/952,688 Date Filed: Mar. 13, 2014 Application Number: Provisional Pat. App. No. 61/952,688

CROSS REFERENCE TO RELATED APPLICATIONS

61/268,214

FEDERALLY SPONSORED RESEARCH

N/A

SEQUENCE LISTING OR PROGRAM

N/A

BACKGROUND OF INVENTION

Field of Invention

This invention relates to containers with multifunctional lids, more specifically to containers with smoking tools attached to their associated caps, making the loading, packing and emptying of pipe bowls faster and easier.

Prior Art

Pipe smokers often use tools to load and pack smoking material into their pipe, and a poker to clean ash from the pipe bowl when finished. Smokers also use ashtrays, and containers for holding smoking material such as herbs or tobacco. However, carrying these tools around can be cumbersome, they are prone to getting lost and dirty, and tools may not be readily available when needed. The present invention solves these problems by providing smoking tools attached to the caps of the containers, hence making these tools easier to find, more convenient to transport, and cleaner and easier to use.

Several ashtrays have been designed that make it easier to empty ash from a pipe bowl. This type of ashtray has a protruding reamer, the smoker turning their pipe upside down so that the reamer in the ashtray goes into the bowl, the user then moving the bowl in a mostly horizontal circular motion to dislodge ash from the bowl. See U.S. Pat. No. 1,356,586 by Aisenstein as an example.

A disadvantage of these ashtrays is that they do not allow the user to easily see the contents of the pipe bowl and the movement of the poker within the bowl, the action of turning one's pipe upside down to empty ash from the bowl also necessitating turning the pipe back over to look into the bowl in order to ascertain the progress of ash removal, which is often insufficient, requiring the process be performed again. These ashtrays also tend to knock-out bowl screens and push ash into the body of the pipe if there is no screen. Additionally, ash tends to spray out from the bowl when using this type of ashtray, landing on surfaces instead of inside the ashtray, as the poker tends to skip across the inner surfaces of the bowl. Uncovered ashtrays are also prone to having ash blown out of it by even a light breeze or when carrying them to a trash bin.

U.S. Pat. No. 1,998,742 by Sussman and U.S. Pat. No. 2,725,884 by Colby are examples of covered ashtrays. A product that is relevant to this application is the Poke-A-Bowl Home Dome ashtray, having both a poker and a cover, indicating the need for a covered ashtray with a built-in poker. This device still requires the user to turn their pipes upside down for proper use. However, none of these devices are intended for use upside down, nor could they conveniently be used in this manner. If the Poke-a-Bowl Home Dome was indeed used upside down, the round top would not be stable on a surface, and a user holding the bottom portion of this device would find it difficult and awkward to grasp and manipulate the bottom portion to remove ash from their pipe bowl.

U.S. Pat. No. 3,413,981 by Polizzi et al, shows a Pocket Ash Tray designed to extinguish cigarettes and cigars with a built-in standard protruding from a bottom cap of a tubular container. Although showing the bottom cap as removable, his device is designed to not have the bottom cap removed during use, and indeed, would be disadvantageous to do so, since the device would no longer serve as an ashtray and would instead discharge ash and cigarette butts from the device. The only reason to remove the bottom cap is for initial manufacture or cleaning, and his device would not work any differently than if the bottom cap was permanently affixed to the container.

Polizzi acknowledges that only the top cap (18) be removed during normal use by the placement of a chain (21) attaching the cap to the container, to prevent it from being lost. If Polizzi had intended, or even conceived that the bottom cap (13) be removed during normal use, he would have likewise placed a chain from the bottom cap to the container. Polizzi's device is also intended to be used in an upright manner.

Nowhere in Polizzi is it suggested using the snuffing head to clean a pipe bowl, nor removing the bottom cap of the device during use. If Polizzi's device were used in the manner of the present invention, several problems would arise. The first is that the container would need to be used upside down, with the top cap resting on a surface while the user empties the bowl of their pipe into the container. The cap has a protruding anchor post (19) affixed to the middle of the cap, therefore the container, while resting upside down on a surface, would not be steady nor stand upright. Chain (21) would add to this unsteadiness. Ash from a pipe bowl being cleaned might therefore miss going into the container completely. If the cap (18) was removed, the hole (17a) in the inner cap (17) would allow ash to fall through the inner cap.

Another disadvantage of Polizzi's standard and enlarged snuffing head is that it, if it even fit inside a pipe bowl, would be an ineffective bowl cleaner, likely scratching the inside of the bowl and being unable to get into the corners, nor be effective in cleaning smaller bowls, nor bowls in most tobacco vaporizing devices. If a conventional pipe poker were to be used in his device instead of the snuffing head, it would not work as intended, since a poker is insufficient for extinguishing a cigarette or cigar. Finally, if Polizzi's device were used in the manner of the present invention, the inner threads of the bottom container and cap could easily get clogged with ash, which would make re-attaching the bottom cap difficult and require more frequent cleaning. In summary, Polizzi's device is designed and intended for extinguishing cigars and cigarettes, not cleaning the bowls of pipes.

There are several storage jars having lids with spoons and scoops protruding from under the lid, some extendable, but none have integral packing means, nor are they intended for use with smoking devices. Examples include U.S. Pat. No. 2,106,313 by Amrine, U.S. Pat. No. 5,251,774 by Engle, U.S. Pat. No. 2,175,735 by Banks, and U.S. Pat. No. 2,149,698 by Humphrey. U.S. Pat. No. 4,717,032 by Wu shows a jar with a spring-actuated tool protruding from the underside of the cap, specifically for use with seasonings, preserving and medical materials. However, none of the above contain means for ejecting and packing materials after being scooped-up.

The present invention solves the above problems in one simple and innovative design.

OBJECTS AND ADVANTAGES

It is the principal object of this invention to provide containers with smoking tools integrally attached to their caps that are easy and inexpensive to manufacture, easy to disassemble and clean. The tools may vary and be removable to enable a customizable experience. Other objects include providing tools that are easy to grasp and manipulate, by way of them being attached to the cap which now also serves as a handle, as well as tools that are ready to use once the cap is removed, thus obviating the need to locate and pick-up a separate tool. Another object is to provide tools which are stored safely, cleanly, and conveniently within their respective containers.

Another object is to provide an ashtray with a cap to keep smoking waste securely within, having an integral poker in its cap providing fast, easy and convenient ash removal from a pipe bowl, which facilitates the efficient moving of both the bowl and the poker, not requiring the bowl to be turned upside-down, allowing for the stirring of an unfinished bowl, and also providing for the reaming of pipes that should not be turned upside down, such as certain water-pipes.

An additional object of this invention is to provide a container for smoking material with a cap having a combination scoop and packer for the fast, efficient, and convenient transfer, loading, and packing of smoking material into a pipe bowl, and providing a scoop with means for ejecting and packing the smoking material. A further object is to provide a scoop that can poke into the corners of its associated container, easily pick-up smoking material and hold it securely within to prevent spillage during transfer, and to provide a scoop which may accurately and consistently measure the amount of smoking material within it.

Another object is to provide a grinding mechanism within the caps that prevents overfilling, with holes in the bottom surface allowing ground material to fall directly into an attached container, with closure means for partially or completely closing those holes, providing a choice of fineness for the ground material, preventing ground material from falling out of the grinding mechanism when cap is removed from container, and allowing the ground material to remain in the grinding mechanism without falling into a container, further allowing use of the two caps together on their own, unattached to any containers.

SUMMARY

This invention relates to containers with multifunctional lids, and more specifically to an improved ashtray with a removable cap having an integral poker on the underside of the cap, as well as a storage jar for smoking materials having a removable cap with a combination scoop and packer protruding from the underside of the cap into the jar.

There are many configurations of this invention, including double-sided versions, whereby two lids may be temporarily or permanently attached at their tops or made as a single part so that they may be used conveniently together, as well as having a built-in grinder for smoking material.

DRAWINGS

Figures

Figure 8:
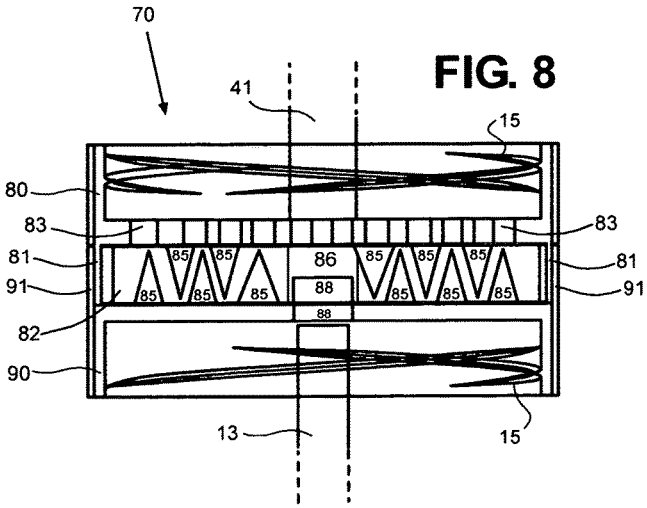

FIG. 8 is a front sectional view of combination grinder cap 70 along line 8-8 showing poker grinder cap 90 and scoop and pack cap 80 removably attached to each other, and showing the grinding mechanizms of both lids in relation to each other.

FIG. 9 is a perspective view of caps 80 and 90.

FIGS. 10 and 11 are top views of caps 80 and 90. respectively.

FIG. 12 is a perspective view of caps 70 attached to each other and their respective containers in use grinding smoking material.

Figure 13:
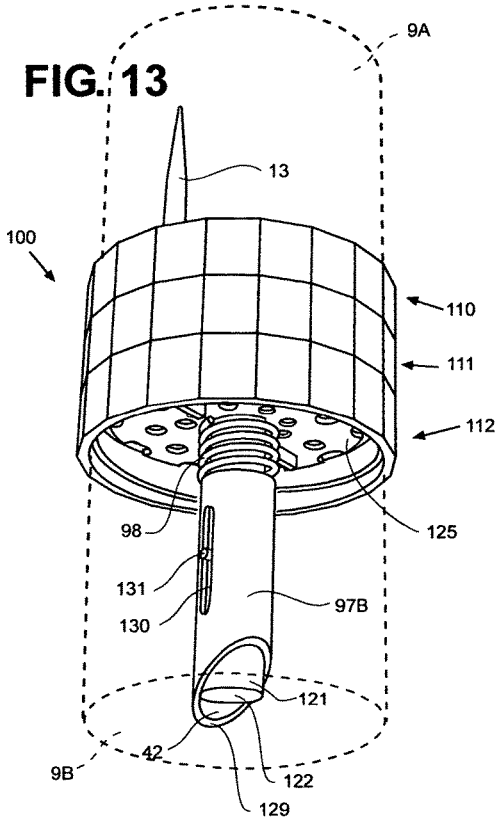
Figure 13:
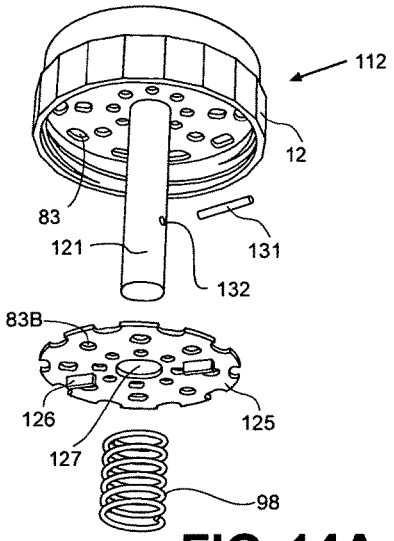

FIG. 13 is a bottom perspective view of attachable cap embodiment 100.

Figure 14A:
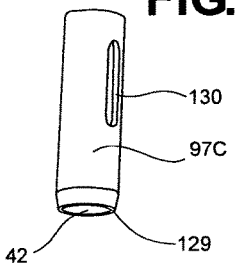

FIG. 14A is a bottom exploded perspective view of the component parts of cap 112.

Figure 14B:
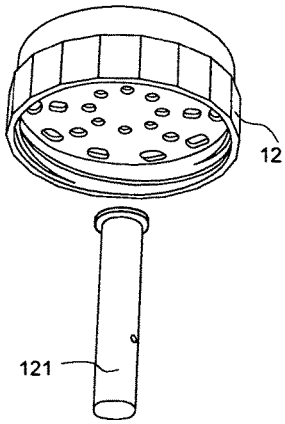

FIG. 14B is a bottom exploded perspective view of cap 112 with separated post 121.

Figure 15:
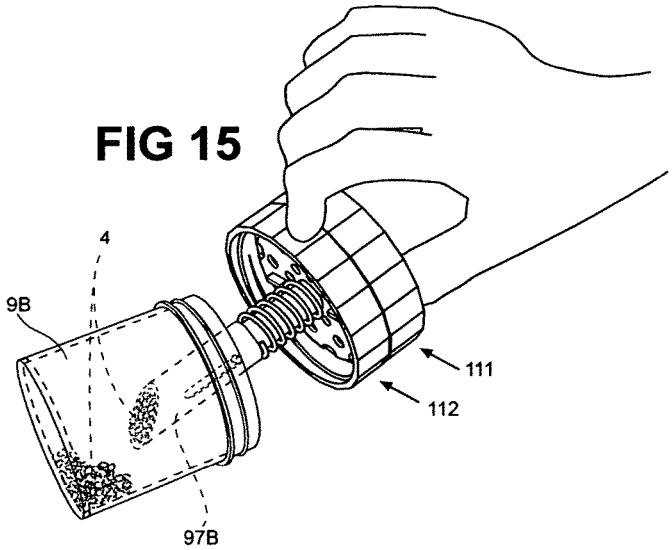

FIG. 15 is a perspective view of cap 112 with cap 111 attached thereon being used to scoop smoking materials out of container 9B.

FIG. 16A is a bottom view of cap 112 with through holes 83 open.

FIG. 16B is a bottom view of cap 112 with through holes 83 partially closed off.

FIGS. 17 and 18 are top and bottom exploded perspective views, respectively, of the compnent parts of embodiment 100 without containers.

Figure 19A:
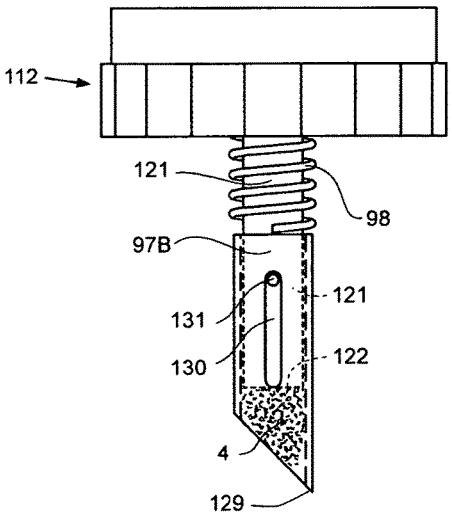
Figure 19B:
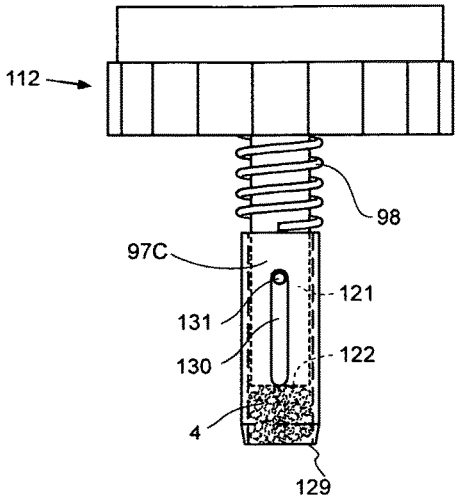

FIGS. 19A and 19B are front views of cap 112 with scoops 97B and 97C, respectively, filled with smoking material.

Figure 20A:
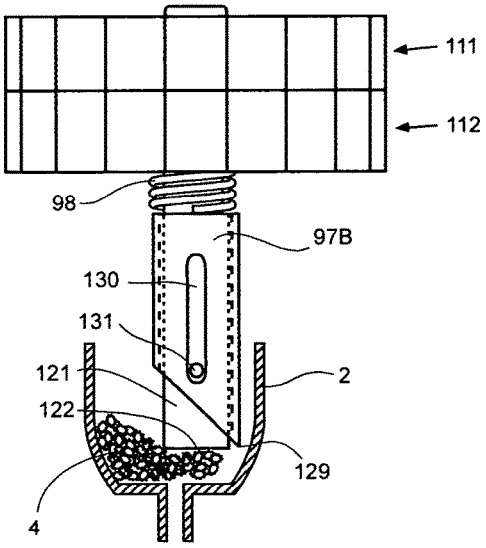
Figure 20B:
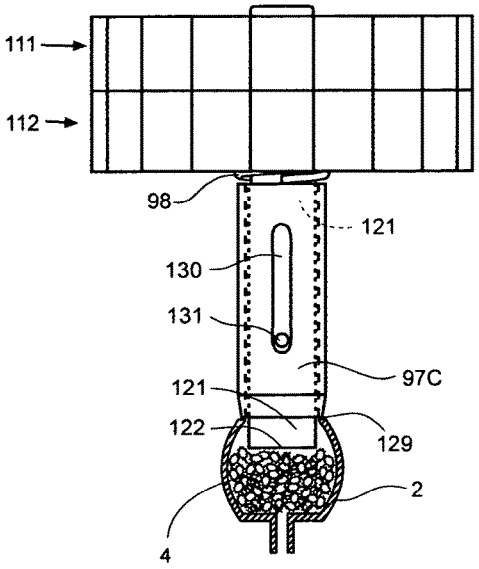

FIGS. 20A and 20B are front views of cap 112 with scoops 97B and 97C, respectively, depositing smoking materials into pipe bowl 2.

Figure 21:
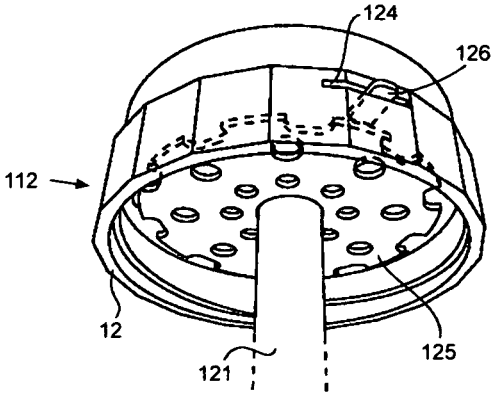

FIG. 21 is a bottom perspective view of closure tab extending out of cap 112.

REFERENCE NUMERALS

1—Smoking pipe
2—Bowl of smoking pipe 1
3—Ash
4—Ground smoking material
7—Container neck
8—Screw threads on container 9
9A—Container used as ashtray

9B—Container used for smoking material
10—Poker Ashtray Combination
11—Poker Cap
12—Screw-on cap
13—Protruding poker
14—Flat sides
15—Screw threads on cap
16—Plate
30—Scoop and Pack Combination
31—Scoop and Pack Cap
41—Scoop and Packer
42—Scooping channel
43—Packing surface
48—Packer
61—Combination poker cap and scoop/packing cap
62—Combination poker cap and scoop and pack cap with containers
70—Grinder Cap Combination
80—Grinder combination scoop and pack cap
81—Inner grinder wall
82 Grinding mechanism and chamber
83—Through holes
85—Grinding Teeth
86—Magnet Boss
87—Magnet indent
88—Magnet
90—Grinder combination poker cap
91—Outer grinder wall
97B—Angled Extension Scoop
97C—Flat Extension Scoop
98—Compression Spring
100—Attachable Cap Embodiment
110—Poker Cap
111—Grinder Cap
112—Scoop and Pack Cap
120—Post Flange
121—Post
122—Post End
124—Closure Channel
125—Closure
126—Tab
127—Post Hole
129—Scoop End
130—Scoop Channels
131—Limiter
132—Limiter Hole
141—Nesting Boss
142—Nesting Indent

PREFERRED EMBODIMENT

Figure 1:
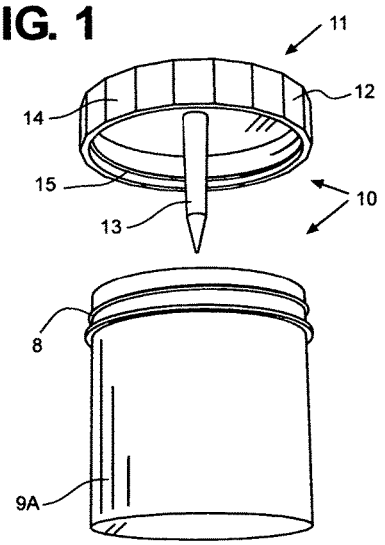
FIG. 1 is a perspective view of a container having a cap with utensil, here a poker.

As best seen in FIGS. 1-4, the preferred embodiment of the invention comprises a container with neck 7 to hold various smoker's items such as smoking material 4 or ash 3, the container having a cap with a smoker's tool attached to it. In FIG. 1, container 9A is used as an ash receptacle. Poker cap 11 and all other embodiments in this application show screw threads 15 on the inner walls of screw cap 12 for removable attachment to container 9A or 9B via screw threads 8 on neck 7 of container 9A, operatively sealing the container. Poker cap 11 is shown here with poker 13 protruding from the underside of cap 12, thereby protruding into container 9A when cap 11 is attached thereon. The perimeter of cap 12 may be shaped for better grasping, herein shown having numerous flat sides 14. All parts described herein may be easily manufactured using, for example, injection molding processes or milling and lathing operations.

Figure 2:
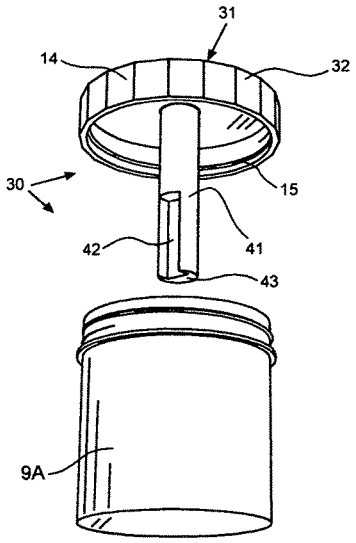
FIG. 2 is a perspective view of a container and cap with a scoop and packer.

FIG. 2 also shows a preferred embodiment of the present invention, comprising container 9B, used to hold smoking material 4, and scoop and pack lid 31, having a combination scoop and packer 41 protruding from the underside of cap 12. Scoop channel 42 is hollowed-out of the end of scoop and packer 41, leaving mostly flat packing surface 43.

DESCRIPTION

Alternate Embodiments

Figure 5:
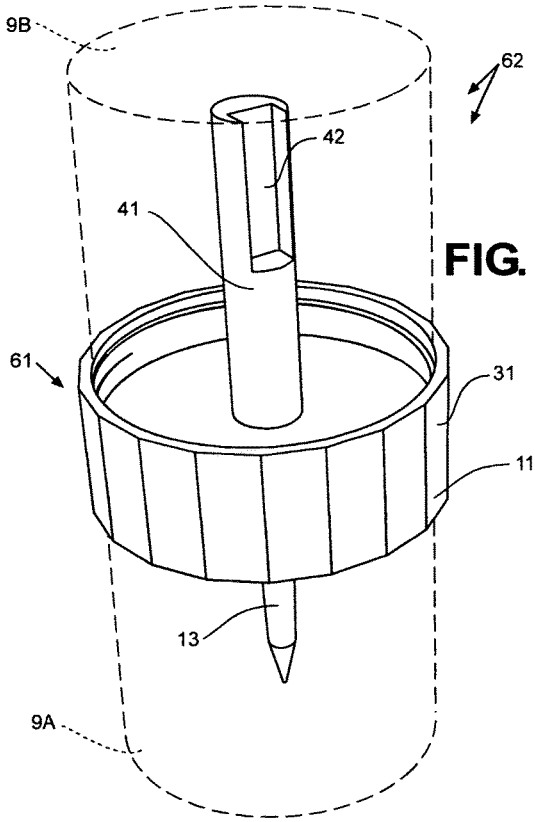
FIG. 5 is a perspective view of a combination cap with a poker extending from one side and a combination scoop and packer extending from the opposite side, removably attached to two containers.

FIG. 5 shows poker cap 11 and scoop and pack cap 31 combined in a single unit as a double-sided cap shown here as combination cap 61, removably attached to containers 9A and 9B.

Figure 7:
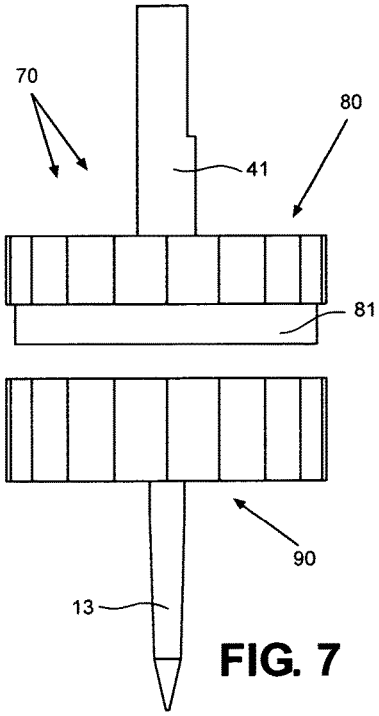
FIG. 7 is a front view of combination grinder cap 70 without its associated containers.

FIGS. 7-9 show combination grinder caps 70 comprising scoop and pack grinder cap 80 and poker grinder cap 90, along with containers 9A and 9B, not shown here. Cap 80 has scoop and packer 41 protruding downward from its inner surface, while cap 90 has poker 13 protruding downward from its inner surface, as described above. Cap 80 is removably secured to cap 90 via the friction created by inner wall 81 within outer wall 91, and magnets 88 that are secured within magnet cavities 87 in caps 80 and 90, using securing means such as glue, sonic welding, or directly molded into the parts. The outer diameter of wall 81 on cap 80 should be slightly less than the inner diameter of wall 91, so that when caps 80 and 90 are attached to each other, wall 81 slides into wall 91, maintaining a close but movable relationship, so that caps 80 and 90 may be rotated around each other.

FIG. 8 shows a front sectional view of caps 80 and 90 along line 8-8 removably attached to each other, with grinding teeth 85 protruding from the upper surfaces of caps 80 and 90. Teeth 85 are disposed in concentric rings and situated on each cap respectively whereby teeth 85 on cap 80 come into close proximity with but do not contact teeth 85 on cap 90 when caps 80 and 90 are rotated around each other. The mostly horizontal surface of cap 80 is referred to as plate 16.

FIGS. 9-11 further show placement and shape of teeth 85, which may vary. Magnet boss 86 protrudes from plate 16 to a length that mostly matches the heights of walls 81 and 91. Magnet indent 87 is located at the end of boss 86, its size and shape closely matching that of magnet 88. Similarly, a second magnet 88 or ferrous material such as iron or steel is secured within magnet indent 87 on cap 90. Magnets 88 are secured within their respective indents so that they attract each other when caps 80 and 90 are appropriately attached to each other. Through holes 83 are interspersed between the locations of teeth 85 on plate 16. Holes 83 can be of various sizes and placement. Holes 83 are not necessary to the functioning of this device, as ground material may simply be poured from the grinding mechanism directly into container 9B. Caps 80 and 90 are removably attached to containers 9A and 9B, as seen in FIG. 12, showing grinder caps 70 being used to grind smoking material.

FIG. 13 shows various designs of scoop and packer 41 to illustrate the diversity of design while still maintaining the spirit of the present invention. Also shown is packer only 48 which has no scoop.

FIGS. 30-38 show alternative embodiment 100 having a separate grinder cap 111 and scoops 97B or 97C, which extend automatically via the urging of compression spring 98 upon it, and retract manually when cap 12 is pressed down upon when scoop end 129 is in contact with a surface.

FIG. 30 shows embodiment 100 assembled and attached to associated containers 9A and 9B, with grinder cap 111 removably attached to scoop and pack cap 112, and poker cap 110 removably attached to the top of grinder cap 111. All three caps are removably attached to each other using a combination of friction and magnetic attraction, although attachment may be accomplished with just one of these, or by other means of attachment. Extension scoop 97B, having an angled scoop, is partially retracted along post 121, here a rod fixed upon screw cap 12, within container 9B, the retraction caused by the bottom of container 9B pushing upwards on scoop 97B when cap 112 is attached to container 9B, as the fully extended length of scoop 97B on post 121 is longer than the depth of container 9B. Post end 122 does not contact the bottom of container 9B, as the length of post 121 is shorter than the depth of container 9B when cap 112 is attached thereon, thus preventing any material beneath post end 122 from being crushed. Scoop 97B is a tube with an angle-cut bottom portion that is slidably and removably attached to post 121, held in place by limiter 131 which allows travel along post 121, movement being restricted by the contact of limiter 131 with either end of channel 130. Restoring spring 98 has an inner diameter that fits unencumbered over post 121, while its overall diameter makes sufficient contact with the base of the scoop. Spring 98 is sandwiched between scoop 97B and optional closure 125 upon post 121, providing means for the extension and retraction of scoop 97B, urging the scoop downwards to normally poke the scoop end 129 onto the bottom of container 9B. Closure 125 is rotatably mounted upon post 121 and held in place by the urging of spring 98. In this embodiment, poker 13 is offset from the center of poker cap 110.

Limiter 131, although secured in place within hole 132, is preferably removable to allow cleaning of the parts and to facilitate the replacement of the scoop. Limiter 131 may take many forms, such as a cylinder, cotter pin, or roll pin. Spring 98 should provide enough resistance to allow scoop to pick-up material 4 with minimal compression, while still being easy to press downward on cap 112 to eject and pack material 4. Limiter 131 limits the upward and downward movement of the scoop so that when the scoop is extended a sufficient space is created within scoop channel 42, up to post end 122, to hold a predetermined amount of ground material within, and when the scoop is fully retracted post end 122 is pressed to or past scoop end 129, so that post end 122 protrudes beyond scoop end 129.

FIG. 31A shows a bottom view of cap 112 with closure 125 in an open position, whereby through holes 83 are free of obstruction. FIG. 31B shows the same view with closure 125 in an partially closed position, having been partially rotated around post 121, whereby through holes 83 are partially blocked by closure 125.

FIGS. 32 and 33 show partially exploded top and bottom perspective views, respectively, in proper order of attachment, of the component parts of embodiment 100. Mostly centered on either side of poker cap 110 are magnet boss 86 protruding perpendicularly from its bottom portion with magnet 88 secured within magnet indent 87, and nesting indent 140, here with a cylindrical shape, sunken in the top portion. Mostly centered on either side of grinder cap 111 are nesting boss 141 protruding from its top portion and magnet indent 87 sunken in the bottom portion with magnet 88 secured therein. Mostly centered on either side of cap 112 are magnet boss 86, having magnet indent 87 at its top end, protruding from the top portion with magnet 88 secured therein and post 121 protruding mostly perpendicularly from the bottom portion. The magnets in all embodiments are oriented directionally whereupon attraction between them is facilitated between attached caps in their respective configuration. All magnets are mostly flush within their respective indents.

Caps 112, 111, and 110 are removably attached via friction and magnetic attraction. Magnet placement is such that when caps 112 and 111 are attached to each other the magnets enclosed therein are closer in proximity to one another than the magnets enclosed in caps 111 and 110 when they are attached to one another, so that poker cap 110 is easier to remove from cap 111 than cap 111 is to remove from cap 112, whereby cap 110 may be removed from embodiment 100 without inadvertently removing cap 111 from cap 112. The magnets in caps 111 and 110 are also separated by part material, which supplements this effect. Boss 141 and indent 140 are similar in size and shape, with indent 140 being larger enough for cap 110 to remain secured to but facilitate easy removal from cap 111 when desired. Walls 81 and 91 provide friction that helps maintain temporary attachment of caps 112 and 111.

Grinding teeth 85 are truncated, the square shape of magnet boss 86 contributing to the grinding process, with holes 83 interspersed throughout plate 16 between teeth 85. Scoop 97B is in a fully extended position along post 121, providing maximum space within scoop opening 42.

FIG. 34 shows an exploded bottom perspective view of cap 112 with scoop 97C, which is similar to scoop 97B but with a flat end 129, which is tapered on its outer edge for easier insertion into material and to center scoop 97C within bowl 2, as seen in FIG. 37B. End 129 may be otherwise shaped so that it centers within or around bowl 2, for example having a stepped or curved inner or outer ledge that the top rim of bowl 2 rests upon when end 129 of scoop 97C is pressed into it, thus facilitating faster placement of the scoop onto the bowl.

The travel distance of scoops 97B and 97C along post 121 is provided by lengthwise through channels 130 on either side of scoops 97B and 97C, the channels width being slightly larger than the diameter of limiter 131 to allow travel of the outer ends of limiter 131 along channels 130. The length of channels 130 is such that it provides ample room for storage of material 4 within scoop opening 42 when the scoop is in an extended position, while allowing post end 122 to protrude to or past scoop end 129 to facilitate packing when the scoop is retracted.

Post 121 has limiter hole 132 there-through, perpendicular to the longitudinal axis of post 121, hole 132 having a similar but slightly larger diameter as limiter 131. Post end 122 is the mostly flat end of post 121 whose purpose is to first eject material from scoop channel 42 when scoop 97B or 97C is retracted inwards, and second to pack material into pipe bowl. Post end 122 may take other forms besides flat, for example it may be curved, angled, pointed, or indented.

Closure 125 comprises a mostly flat disk with through holes 83B that mostly match the size, shape and placement of through holes 83, so that, upon rotation of closure 125 around post 121, holes 83 are either open when they line up with holes 83B or mostly closed when they line-up with the solid segments of closure 125. The outer set of holes 83B may be truncated, as shown here, to allow for unhindered rotation of closure 125 within cap 12 and container 9B. Closure 125 has tabs 126 protruding from its bottom surface, and a post hole 127 mostly centered therein, the diameter of post hole 127 being slightly larger than the diameter of post 121, to allow for the rotation of closure 125 around post 121. Closure 125 may take other forms, for example it may have means for activation that extend outward into a portion of cap 112, as shown in FIG. 38, or it may open and close automatically when cap 112 is attached and unattached to container 9B. FIG. 38 shows cap 112 having a mostly horizontal tab channel 124 to accommodate tab 126 that extends past cap 12 so that closure 125 may be rotated while cap 112 is attached to container 9B.

To assemble cap 112, first closure 125, then spring 98, and then extension scoop 97B or 97C is placed over post 121 and pushed in until limiter 131 can be inserted through channel 130 on one side of the scoop, then through limiter hole 132, and finally out through channel 130 on the opposite side of the scoop, so that the ends of limiter 131 extend mostly equally out from either side of post 121 into channels 130 on both sides of scoop, thereby slidably attaching the scoop to post 121. Other means for holding the respective parts in place may be used, and may be permanent if desired.

The tools, such as post 121 and scoop and packer 41 may, instead of being manufactured as a single piece with its associated cap, be manufactured separately and subsequently fixed, permanently or removably, under cap 12 by adhesive, press-fit, interlocking means, welding or other mechanical method known by those skilled in the art, and may have means for centering upon each other, for example as shown in FIG. 34A, where post 121 is a longitudinal cylinder having a top flange 120, which is fixed under cap 12 in a similar fashion as described above.

OPERATION

Preferred Embodiment

Figure 3:
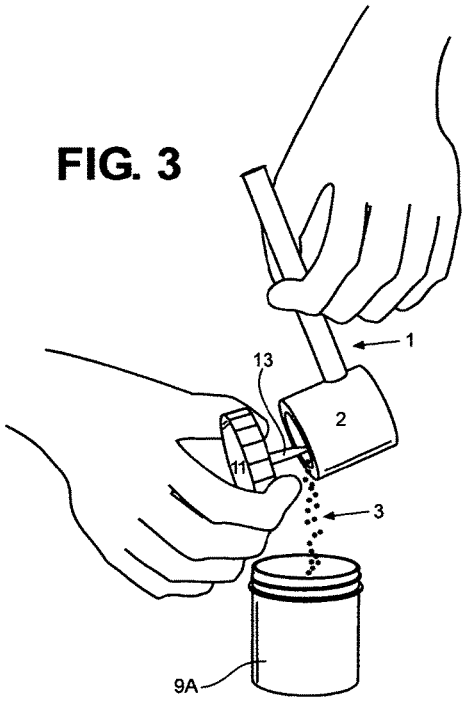
FIG. 3 is a perspective view of a container having a cap with a poker, being used to loosen and remove ash from the bowl of a smoking pipe.

Operation of cap 11 is shown in FIG. 3, typically after smoking a pipe. After unscrewing poker cap 11 from container 9A, a grasp is maintained on cap 12 while pipe 1 is held in the other hand. Flat sides 14 assist in this grasping. Ash is loosened within bowl 2 using poker 13, then pipe 1 is turned over in the manner shown, pouring loose ash 3 into container 9A. Bowl 2 may also be tapped with cap 12 to further loosen ash.

Figure 4:
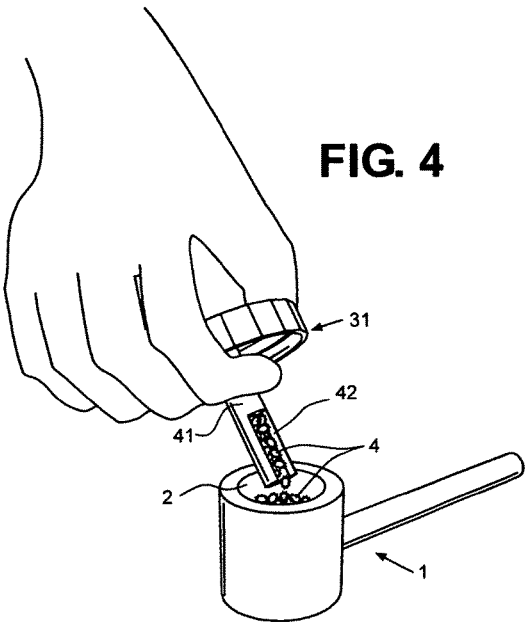
FIG. 4 is a perspective view of a container having a cap with a combination scoop and packer, being used to load smoking material into the bowl of a pipe.
Figure 6:
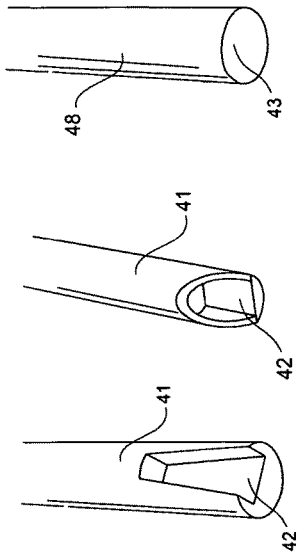
FIG. 6 is a perspective view of different configurations of the scoop and packer.

Operation of cap 31 is shown in FIG. 4. This embodiment is used to load and pack smoking material 4 into bowl 2 of pipe 1. Cap 31 is removed from its associated container 9B, filled with smoking material 4, and while maintaining a grasp on cap 12, scoop and packer 41 is dipped into container 9B and manipulated until material 4 is scooped into scoop channel 42. Scoop and packer 41 is then removed from container 9B, then inserted into bowl 2, whereby smoking material 4 is deposited, via gravity, shaking, tapping, or other means, after which smoking material 4 may be packed into bowl 2 by pressing packing surface 43 into material 4. This process may be repeated until bowl 2 is sufficiently filled. Caps 11 and 31 are reattached to their respective containers when finished.

Alternate Embodiments

Combination cap 61 and combination device 62 shown in FIG. 5 are operated in a similar manner to caps 11 and 31, as discussed above, with the additional benefit of having two or more tools and containers available in a single device, as well as now having the opposite container from the one that is currently removed serve as handle for the tool in use, thus providing extra area for grasping and easier manipulation of the tool.

As shown in FIGS. 9-12, grinder caps 70 are operated in a similar manner to device 62, with the additional benefit of an internal grinding mechanism and chamber 82 that is created between the interlocking areas of caps 80 and 90 when they are properly attached to each other.

With caps 80 and 90 separated but attached to their respective containers, whole smoking material, such as the leaves of tobacco, mullein, sage, damiana, *cannabis*, and marshmallow, is placed into chamber 82 which is formed in the space between wall 81, teeth 85, and magnet boss 86 in cap 80. Cap 90 is then pressed firmly into and attached to cap 80, as described above, following which caps 80 and 90 are rotated in counter directions to each other, as shown in FIG. 12. This process continues until the leaves are fully ground between grinding teeth 85 and by the process of gravity, shaking, and other means, ground material 4 is ejected through holes 83 into container 9B for storage. Ground material 4 can now be scooped-up, deposited, and packed into a the bowl of a smoking device, as described above.

Embodiment 100 works similarly to the previously described embodiments, but with a separate grinder cap 111, extending scoops 97B and 97C, and inner ejecting and packing mechanism in the form of post end 122.

Closure 125 is opened before grinding takes place, by pushing on one or more tabs 126 to rotate closure 125 so that holes 83B are closely lined-up with holes 83, creating through holes, as shown in FIG. 31A, or only partially lined-up, whereby holes 83 are partially blocked by the solid part of closure 125, as shown in FIG. 31B, for finer ground material.

Cap 111 is then removed from cap 112, and material to be ground is inserted into chamber 82 in cap 112. Top 111 is replaced upon cap 112, and grinding is commenced, as described above. Cap 110 may be removed before engaging in the grinding process.

To dispense ground material 4 into pipe bowl 2, cap 112 is removed from container 9B, then closure 125 is rotated so that holes 83 are mostly blocked by the solid interweave of closure 125, which helps prevent accidental spilling of any material remaining in the grinding chamber 82 during dispensation, which is further aided by keeping top 111 on cap 112 during this process, as shown in FIG. 35.

With scoop 97B or 97C extended to its full length, providing extra reach into the bottom of container 9B, material 4 is scooped from container 9B into scoop channel 42, as shown in FIGS. 35-36B. Cap 112 may be slightly pressed downward while scooping so that post end 122 is pressed into material 4, compacting it and therefore making it easier to transport. Finally, as shown in FIGS. 37A-37B, scoop end 129 is situated over pipe bowl 2, then lowered so that scoop end 129 contacts either the upper rim or bottom of bowl 2, depending on the bowl and scoop in use, and cap 12 is pressed downwards manually, whereby the scoop retracts inward along post 121, against the urging of spring 98, resulting in post end 122 first ejecting material 4 from scoop opening 42 and then packing material 4 into bowl 2 upon further retraction of the scoop.

Angled scoop 97B is recommended for larger or more open bowls, since material 4 can exit scoop 97B through the side opening created by the angle, as shown in FIG. 37A, whereas flat scoop 97C is recommended for bowls that are smaller with a rim diameter closely matching the diameter of scoop end 129 of 97C, whereby end 129 rests upon the rim of bowl 2 before cap 112 is pressed to dispense material 4 into bowl 2, as shown in FIG. 37B. Scoops 97B and 97C are interchangeable and work similarly. The design of scoops 97B and 97C also allow them to be used additionally as, for example, a poker, mixer, or packer.

When finished smoking, ash may be removed from bowl 2 as described above. Poker 13 is offset, which facilitates access to hard-to-reach areas.

The main components of the present invention may be used fully or partially assembled. For example, ashtray container 9A and poker cap 11 may be used together as one, and cap 112 and top 111 along with container 9B may be used together as one.

CONCLUSION, RAMIFICATIONS, AND SCOPE

Accordingly, the reader will see that, according to the present invention, a simple and innovative solution has been provided for the loading, packing, and reaming of a bowl in a smoking device, as well as the convenient grinding of and storage of smoking material and ash. While the above description contains many specificities, these should not be construed as limitations on the scope of my invention, but as exemplifications of the presently preferred embodiments thereof. Many other ramifications and variations are possible within the teachings of the invention.

For example, different types, sizes, and configurations of containers may be used, inserts such as silicone may be used in conjunction with the containers, and other types of attachment means to their associated caps may be used.

The grinder portion may have through holes that have means for allowing ground material to fall downward into the container, but prevent the ground material from going back into the grinding chamber when the device is turned upside-down.

Alternatively, means may be provided for automatically opening the through holes when the grinder is attached to a container, but close automatically once the grinder is removed from the container.

The scoop may have means for easier dispersal of ground material, such as by modifying its shape, as shown in FIG. 13, or coating it with non-stick technology such as Teflon. Channel 130 may be open-ended at its lower portion to allow for easier manufacturing, as the compressed spring will act to limit the upward travel of the scoop.

The dimensions and configurations of the scoop, packer, post, limiter, limiter hole, spring and container may vary to better fit and work with different-sized and shaped bowls, as well as to hold a particular amount of ground material in the scoop. The scoop can be open or closed-off at its sides or top, and the post end may not protrude to or past the scoop end whereby it only ejects material from scoops, and may not perform a packing function. Additionally, other means for temporary or permanent attachment of scoops to post may be used, for example integral tongues and grooves.

Tools may be removable and replaceable, allowing different tools to be substituted or removed completely while providing the option to use the tools without the cap being attached to them. Many methods for attachment may be used, such as screw threads, friction fit, and snap fit. Alternatively, tools may not be attached to cap at all, and instead may reside within the container to be used independently. For example, the scoop and packer mechanism may be made as a standalone device for use with other containers. More than one tool may be attached to a cap, on the same or opposite sides of the cap. Many different tools may be utilized within the present invention, for example tongs, spear, grabber, knife, scraper, scissors, clip, tweezers, magnifying glass, lighter, rolling paper dispenser, and the like.

The spring may be housed to keep it cleaner, and other means for the retraction and extension of scoops may be used.

Device may be integrated with both halves contributing to a unified whole, or may be used as two separate devices that may be temporarily linked together. Additionally, the jars and caps may be interchanged, for example container 9A can hold whole smoking material instead of ash, having a sharp poker in its cap for spearing, or no tool at all.

Naturally, other materials such as powders, arts and crafts items, herbs, spices, and other foods such as syrups and sprinkles, and the like may also be scooped-up and delivered in accordance with the present invention. The scoops and scoop openings 42 used in this instance would benefit from holding predetermined amounts used in cooking, for example a teaspoon or tablespoon.

While the above description contains many specificities, these should not be construed as limitations on the scope of the invention, but as exemplifications of the presently preferred embodiments thereof. Many ramifications and variations are possible within the teachings of the invention. Thus the scope of the invention should be determined by the appended claims and their legal equivalents, not by the examples given.

What is claimed is:

1. A device for a smoking apparatus comprising:
   - a. A container having an aperture;
   - b. At least one cap to close said aperture;
   - c. At least one tool detachably connected to said at least one cap, the at least one tool comprises a combination scoop and packer, said combination scoop and packer comprises:
     - i. A scoop having a scoop end, and at least one lengthwise scoop channel;
     - ii. A packer comprising a post having a lengthwise axis, a post end for packing, and at least part of the post is positioned within said scoop;
     - iii. A restoring spring mounted on said post between said scoop and said at least one cap to allow said scoop to extend downwards to have the scoop end engage a bottom of said container, and allow said scoop to retract upwards to allow said post end to protrude beyond said scoop end; and
     - iv. Said post having a limiter hole positioned perpendicular to the lengthwise axis of said post, and a cylindrical limiter positioned within said limiter hole, wherein the diameter of said limiter hole is larger than the diameter of said cylindrical limiter, and wherein the width of said at least one scoop channel is larger than said diameter of said cylindrical limiter;
   - d. The at least one cap comprising a first cap and a second cap, said first cap comprising a bottom opening and a plurality of top teeth protruding downward, and having a chamber for receiving materials to be ground;
   - e. Said second cap comprises a top opening that engages with said bottom opening of said first cap, said second cap comprises a bottom opening for closable engagement with said container, and a plate separating said top and bottom openings of said second cap, wherein said plate comprises a plurality of bottom teeth protruding upward, said bottom teeth disposed to slidably engage with said top teeth of said first cap;
   - f. Said second cap comprising a chamber for receiving materials to be ground and a plurality of holes in said plate for discharging ground material from said chamber, said bottom teeth engage and grind said materials between the faces of said bottom and top teeth in order to produce a ground output when said second cap is rotated relative to said first cap around an axis common to said first and second caps when said first and second caps are removably attached to each other; and g. a rotatable flat disk for closing said plurality of holes in said plate.

2. A method of filling a smoking device with material for smoking, comprising:

a. providing the device of claim 1;

b. Providing a smoking apparatus having a cavity for filling with material for smoking;

c. Providing said material for smoking;

d. Scooping said material for smoking into said scoop;

e. Depositing said material for smoking from said scoop into said cavity; and f. Packing said material for smoking into said cavity with said packer.

* * * * *